US010206449B1

(12) United States Patent
Weber et al.

(10) Patent No.: US 10,206,449 B1
(45) Date of Patent: Feb. 19, 2019

(54) SANDALS

(71) Applicant: JACQ LLC, Selah, WA (US)

(72) Inventors: James Christian Weber, Selah, WA (US); Daniel Thomas Yorba, Portland, OR (US)

(73) Assignee: JACQ LLC, Selah, WA (US)

( * ) Notice: Subject to any disclaimer, the term of this patent is extended or adjusted under 35 U.S.C. 154(b) by 0 days.

(21) Appl. No.: 15/927,718

(22) Filed: Mar. 21, 2018

(51) Int. Cl.
*A43B 3/12* (2006.01)
*A43B 3/10* (2006.01)
*A43B 13/12* (2006.01)

(52) U.S. Cl.
CPC ..... *A43B 3/102* (2013.01); *A43B 3/12* (2013.01); *A43B 3/128* (2013.01); *A43B 13/12* (2013.01)

(58) Field of Classification Search
CPC ..... A43B 3/12; A43B 3/128; A43B 13/12
USPC ..... 36/11.5, 7.8, 37, 58.5, 58.6
See application file for complete search history.

(56) References Cited

U.S. PATENT DOCUMENTS 1,763,283 A * 6/1930 Ward ..... A43B 23/22 36/58.5
1,993,208 A * 3/1935 Cohn ..... A43B 13/181 36/17 R
2,069,752 A 2/1937 Dorr
2,746,178 A * 5/1956 Miller ..... A43B 13/41 36/58.5
2,957,253 A * 10/1960 Meltzer ..... A43B 3/126 36/11.5
2,969,600 A * 1/1961 Meltzer ..... A43B 23/28 36/58.5
3,039,207 A * 6/1962 Lincors ..... A43B 13/18 36/58.5
3,142,910 A * 8/1964 Levine ..... A43B 21/32 36/105
3,436,842 A * 4/1969 Maxwell ..... A43B 23/28 36/58.5
5,052,130 A * 10/1991 Barry ..... A43B 5/049 36/107

(Continued)

FOREIGN PATENT DOCUMENTS

DE 202008002681 U1 6/2008
EP 0873694 A1 10/1998

OTHER PUBLICATIONS

English-language machine translation of German Utility Model No. DE202008002681U1, Jun. 26, 2008.

*Primary Examiner* — Marie D Bays
(74) *Attorney, Agent, or Firm* — Dascenzo Intellectual Property Law, P.C.

(57) ABSTRACT

Sandals are disclosed herein. A sandal includes a sole assembly and a retention structure. The sole assembly is configured to transition between a flattened conformation and a raised conformation. The sole assembly has a forefoot region, a heel region, and a midfoot region. The sole assembly includes a foot bed configured to face the wearer's foot and an outsole extending underneath the foot bed and configured to contact a ground surface. In the flattened conformation, the sole assembly is at least substantially flat. In the raised conformation, the sole assembly is contoured to raise the heel region relative to the forefoot region. The sole assembly is biased toward the raised conformation, and includes a conformation bias element configured to bias the sole assembly toward the raised conformation.

21 Claims, 6 Drawing Sheets

(56) References Cited

U.S. PATENT DOCUMENTS

| | | | | |
|---|---|---|---|---|
| 6,145,220 | A * | 11/2000 | Johnson, Jr. ..... | A43B 21/26 36/30 R |
| 6,516,538 | B2 | 2/2003 | Kraft | |
| 7,823,299 | B1 | 11/2010 | Brigham | |
| 8,381,415 | B1 | 2/2013 | Lanoue et al. | |
| 8,819,964 | B2 | 9/2014 | Mizrahi-Shapiro | |
| 9,032,643 | B2 | 5/2015 | Yen | |
| 9,192,206 | B2 | 11/2015 | Yen | |
| 2008/0168682 | A1 | 7/2008 | Le | |
| 2008/0196269 | A1 | 8/2008 | Bathum | |
| 2009/0044423 | A1 | 2/2009 | Amsterdam | |
| 2009/0113767 | A1 | 5/2009 | Lee | |
| 2009/0151201 | A1 | 6/2009 | Lee | |
| 2009/0313849 | A1 | 12/2009 | Shelton | |
| 2009/0313854 | A1 | 12/2009 | Clarke | |
| 2009/0320325 | A1 | 12/2009 | Escario | |
| 2010/0037487 | A1 | 2/2010 | Connett | |
| 2012/0311886 | A1 | 12/2012 | Reno, III | |

* cited by examiner

SANDALS

FIELD

The present disclosure relates to footwear, and more particularly to sandals.

BACKGROUND

Casual footwear such as sandals may include minimal structure for retaining the footwear against a wearer's foot. For example, sandals such as flip-flops or thong sandals typically are retained against the wearer's foot via one or more thin straps extending primarily over the wearer's forefoot. While such a design may benefit from a low material cost and offer comfort in warm weather, this design also may cause discomfort while walking. For example, as the wearer walks while wearing such sandals, the wearer's heel may lift off of the foot bed of the sandal, which may cause the foot bed to shift relative to the wearer's foot. To counteract this, the wearer may flex their toes in an effort to retain at least a forefoot region of the foot bed against the wearer's foot and/or to urge a heel region of the foot bed toward the wearer's heel. This type of compensation may cause foot pain in the short term and/or hip or knee problems with prolonged use. Additionally, such sandals may cause an undesirable slapping noise when the wearer lifts their foot from the ground and the foot bed springs back into contact with the wearer's heel. Thus, there exists a need for sandals that retain the heel region of the foot bed against the wearer's heel throughout the entire gait cycle.

SUMMARY

Sandals are disclosed herein. A sandal includes a sole assembly and a retention structure configured to at least partially retain the sole assembly against a wearer's foot. The sole assembly is configured to transition between a flattened conformation and a raised conformation. The sole assembly has a forefoot region configured to be positioned under the wearer's forefoot when the wearer wears the sandal, a heel region configured to be positioned under the wearer's heel when the wearer wears the sandal, and a midfoot region extending between the forefoot region and the heel region. The sole assembly includes a foot bed configured to face the wearer's foot when the wearer wears the sandal and an outsole extending underneath the foot bed and configured to contact a ground surface when the wearer wears the sandal and walks upon the ground surface. In the flattened conformation, the sole assembly is at least substantially flat. In the raised conformation, the sole assembly is contoured to raise the heel region relative to the forefoot region. The sole assembly is biased toward the raised conformation, and includes a conformation bias element configured to bias the sole assembly toward the raised conformation.

DETAILED DESCRIPTION

FIGS. 1-13 provide examples of sandals 10 according to the present disclosure. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numbers associated therewith may be utilized herein for consistency. Elements, components, and/or features that are discussed herein with reference to one or more of FIGS. 1-13 may be included in and/or utilized with the subject matter of any of FIGS. 1-13 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
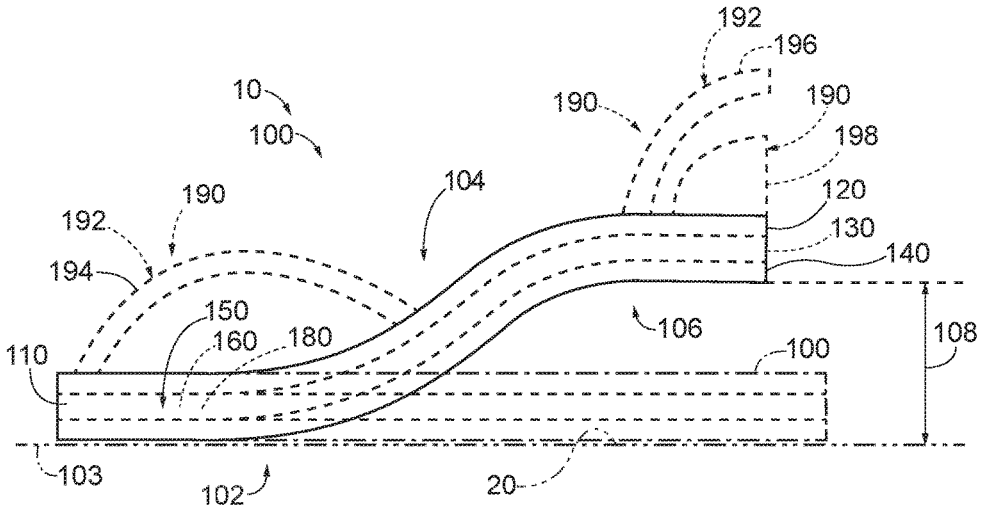
FIG. 1 is a schematic side elevation view representing examples of sandals according to the present disclosure.

As schematically illustrated in FIG. 1, a sandal 10 includes a sole assembly 100 and a retention structure 190 configured to at least partially retain the sole assembly against a wearer's foot. Sole assembly 100 includes a foot bed 120 configured to face and/or contact the wearer's foot when the wearer wears the sandal. References herein to the wearer's foot contacting or being contacted by portions of sole assembly 100 do not require direct physical contact, as a wearer may wear a sock, for example. Additionally or alternatively, references herein to the wearer's foot may refer to the wearer's foot and any sock, stocking, athletic wrap, or other layer that extends around the wearer's foot prior to donning sandal 10. Sole assembly 100 additionally includes an outsole 140 extending underneath the foot bed and configured to contact a ground surface 20 when the wearer wears the sandal and walks upon the ground surface.

As used herein, the terms "upper," "above," "top," "lower," "below," "bottom," and similar terms as used to describe spatial relationships between components of a sandal 10, and/or between a component of a sandal 10 and ground surface 20 or another object, are considered from the perspective of the sandal positioned in an upright orientation on a level ground surface. Accordingly, an upper surface, top surface, or top side refers to a surface or side of a component that generally faces away from ground surface 20, and a bottom surface, lower surface, or lower side refers to a surface or side that generally faces toward the ground surface.

Foot bed 120 may be coupled to outsole 140 in any appropriate manner, such as by adhering, fastening, sewing, and/or welting. Alternatively, foot bed 120 and outsole 140 may be integrally formed and/or may refer to distinct and/or respective components of a monolithic sole assembly 100. As schematically illustrated in FIG. 1, in some examples, sole assembly 100 additionally may include a midsole layer 130 positioned between foot bed 120 and outsole 140.

Foot bed 120, midsole layer 130, and/or outsole 140 may have any appropriate respective and/or collective properties for supporting the wearer's foot. For example, foot bed 120, midsole layer 130, and/or outsole 140 may be configured to provide arch support to an arch region of the wearer's foot when the wearer wears sandal 10.

Sole assembly 100 and/or any component thereof may be formed of any appropriate material. As examples, each of foot bed 120, midsole layer 130, and/or outsole 140 may be formed of a plastic, a rubber, a leather, a natural fiber, a polymer, a foam, ethylene vinyl acetate (EVA), and/or polyurethane (PU).

Sandal 10 may include and/or be any appropriate type and/or style of sandal, examples of which include a thong sandal and a flip-flop sandal. In such an embodiment, and as schematically illustrated in FIG. 1, retention structure 190 may include and/or be at least one strap 192 operatively coupled to sole assembly 100, such as at least one forefoot strap 194 configured to overlie at least a portion of the wearer's forefoot when the wearer wears sandal 10. In such an embodiment, strap 192 may extend at least partially through sole assembly 100 and/or foot bed 120. Additionally or alternatively, and as further schematically illustrated in FIG. 1, retention structure 190 and/or strap 192 may include at least one heel strap 196 configured to at least partially wrap around the wearer's heel when the wearer wears sandal 10, and/or may include a heel cup 198 configured to cradle at least a portion of the wearer's heel when the wearer wears the sandal. However, this is not required to all sandals 10 according to the present disclosure, and it is additionally within the scope of the present disclosure that some examples of sandal 10 may not include, and/or may be free of, a heel strap. Similarly, some examples of sandal 10 may not include, and/or may be free of, a mechanical fastener for selectively adjusting the size of retention structure 190 and/or an upper configured to at least substantially surround the wearer's foot when the wearer wears the sandal.

As schematically illustrated in FIG. 1, sole assembly 100 may be described as including a forefoot region 102, a midfoot region 104, and a heel region 106. As used herein, midfoot region 104 additionally or alternatively may be referred to as an arch region 104 of sole assembly 100. Forefoot region 102, midfoot region 104, and/or heel region 106 may refer to, or be, discrete or well-defined regions of sole assembly 100; may refer to, or be, general regions of the sole assembly; and/or may refer to, or be, relative regions of the sole assembly. As an example of relative regions of sole assembly 100, midfoot region 104 may be described as separating forefoot region 102 and heel region 106.

Additionally or alternatively, forefoot region 102, midfoot region 104, and/or heel region 106 may be described with reference to portions of sole assembly 100 that correspond to portions of a wearer's foot when the wearer wears sandal 10. For example, forefoot region 102 may refer to a region of sole assembly 100 that is positioned generally underneath a forefoot and/or one or more toes of the wearer's foot, midfoot region 104 may refer to a region of the sole assembly that is positioned generally underneath a midfoot and/or an arch of a wearer's foot, and/or heel region 106 may refer to a region of the sole assembly that is positioned generally underneath the heel of the wearer's foot.

Forefoot region 102, midfoot region 104, and/or heel region 106 each may occupy any suitable proportion of sole assembly 100. For example, each of forefoot region 102, midfoot region 104, and/or heel region 106 may individually occupy at least 5%, at least 10%, at least 15%, at least 20%, at least 25%, at least 30%, at least 35%, at least 40%, at least 45%, at least 50%, at least 55%, less than 100%, less than 90%, less than 70%, less than 60%, less than 57%, less than 53%, less than 47%, less than 43%, less than 37%, less than 33%, less than 27%, less than 23%, less than 17%, less than 13%, less than 7%, and/or less than 3% of a longitudinal extent of sole assembly 100 as measured in an anterior-posterior direction. Two or more of forefoot region 102, midfoot region 104, and/or heel region 106 may occupy the same, or substantially the same, proportion of the longitudinal extent of sole assembly 100, or each region may occupy a unique proportion of the longitudinal extent of the sole assembly.

Sole assembly 100 is configured to transition between a flattened conformation and a raised conformation. More specifically, and as schematically illustrated in FIG. 1, sole assembly 100 is at least substantially flat when in the flattened conformation (dash-dot lines in FIG. 1), and is contoured to raise heel region 106 relative to forefoot region 102 when in the raised conformation (solid lines in FIG. 1). Such a configuration serves to facilitate heel region 106 remaining at least substantially in contact with and/or in close proximity to the wearer's heel as the wearer walks upon ground surface 20 while wearing sandal 10.

During use of sandal 10, such as while the wearer walks upon ground surface 20 while wearing the sandal, sole assembly 100 may be described as transitioning between the flattened conformation and the raised conformation, or at least toward the raised conformation, such as via a continuum of intermediate conformations. Additionally or alternatively, the raised conformation of sole assembly 100 may refer to a conformation assumed by the sole assembly when the sole assembly is not acted upon by external forces, such as from ground surface 20 and/or the wearer's foot. Stated differently, the raised conformation may refer to a nominal conformation assumed by sole assembly 100 when sandal 10 is removed from the wearer's foot. Accordingly, in some examples of sandal 10 (and/or of the wearer), wearing the sandal may at least partially deform the sandal throughout the wearer's gait cycle such that sole assembly 100 does not fully assume the raised conformation while the wearer wears the sandal. In such an example, sole assembly 100 may be described as transitioning from the flattened conformation toward the raised conformation when the wearer walks upon ground surface 20 while wearing sandal 10.

Figure 2:
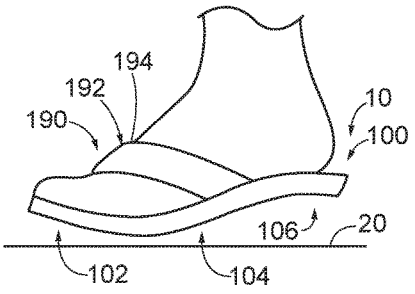
FIG. 2 is a side perspective view representing an example of a sandal according to the present disclosure being worn by a wearer and immediately prior to the wearer stepping upon a ground surface.
Figure 3:
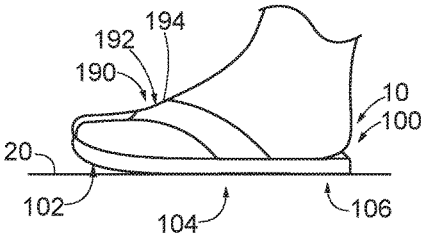
FIG. 3 is a side perspective view representing the sandal of FIG. 2 being worn by a wearer while the wearer steps upon a ground surface.
Figure 4:
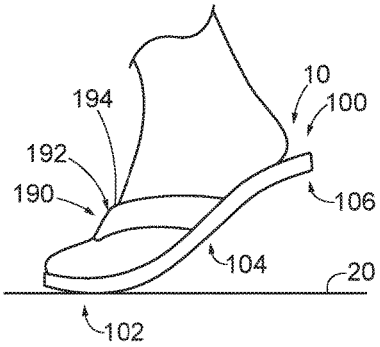
FIG. 4 is a side perspective view representing the sandal of FIGS. 2-3 being worn by a wearer while the wearer lifts the wearer's heel from the ground surface.
Figure 5:
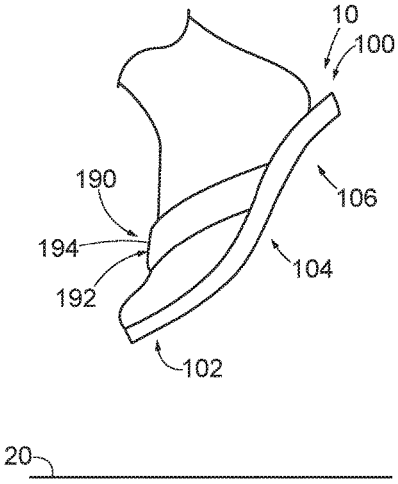
FIG. 5 is a side perspective view representing the sandal of FIGS. 2-4 being worn by a wearer after the wearer lifts the wearer's entire foot from the ground surface.

FIGS. 2-5 depict a wearer taking a step upon ground surface 20 while wearing sandal 10. Specifically, FIG. 2 illustrates sandal 10 immediately prior to the wearer stepping upon ground surface 20; FIG. 3 illustrates the sandal while the wearer steps upon the ground surface (i.e., while applying weight to sandal 10); FIG. 4 illustrates the sandal while the wearer lifts the wearer's heel from the ground surface; and FIG. 5 illustrates the sandal after the wearer lifts the wearer's entire foot from the ground surface. Sole assembly 100 may be described as being in the flattened conformation in FIG. 3, and may be described as being transitioned away from the flattened conformation and/or as being transitioned toward the raised conformation in each of FIGS. 2 and 4-5.

As illustrated in FIGS. 2-5, the elevation of heel region 106 relative to forefoot region 102 when sole assembly 100 is transitioned toward the raised conformation facilitates the wearer's heel remaining in contact with and/or in close proximity to the heel region of the sole assembly through the entire step cycle. In some examples, such a configuration may permit the wearer to walk while wearing sandal 10 without heel region 106 of sole assembly 100 slapping the heel of the wearer's foot, without the sole assembly shifting out of alignment with the wearer's foot, and/or without flexing the wearer's toes to urge the heel region toward the heel of the wearer's foot.

Sole assembly 100 may be contoured in any appropriate manner when in the raised conformation. For example, and as schematically illustrated in FIG. 1, when sole assembly 100 is in the raised conformation, a top surface of foot bed 120 may be concave in forefoot region 102 and/or in midfoot region 104, and/or may be convex in the midfoot region and/or heel region 106. Additionally or alternatively, and as further schematically illustrated in FIG. 1, when sole assembly 100 is in the raised conformation, a bottom surface of outsole 140 may be convex in forefoot region 102 and/or midfoot region 104, and/or may be concave in the midfoot region and/or heel region 106.

As further schematically illustrated in FIG. 1, sole assembly 100 and/or heel region 106 may be characterized by a heel offset 108 when the sole assembly is in the raised conformation. More specifically, and as schematically illustrated in FIG. 1, when sole assembly 100 is in the raised conformation, forefoot region 102 may be described as contacting and/or extending at least substantially in a forefoot plane 103 such that heel region 106 is offset from the forefoot plane by heel offset 108. As illustrated in FIG. 1, heel offset 108 may be measured in a direction perpendicular to forefoot plane 103 between the forefoot plane and a portion of outsole 140 that is maximally distal the forefoot plane. Stated differently, heel offset 108 may correspond to a maximum perpendicular distance between forefoot plane 103 and outsole 140 within heel region 106. As examples, heel offset 108 may be at least 40 millimeters (mm), at least 60 mm, at least 80 mm, at least 100 mm, at most 110 mm, at most 90 mm, at most 70 mm, and/or at most 50 mm.

As discussed herein, sole assembly 100 generally is biased toward the raised conformation, and is configured to transition from the raised conformation to the flattened conformation responsive to the wearer stepping on ground surface 20 while wearing sandal 10. More specifically, and as illustrated in FIGS. 2-3, sole assembly 100 generally is configured to transition to the flattened conformation (FIG. 3) responsive to the wearer compressing each of forefoot region 102 and heel region 106 against ground surface 20, such as by applying and/or shifting the wearer's weight to the foot that wears sandal 10. Sole assembly 100 subsequently transitions from the flattened conformation toward the raised conformation responsive to the wearer's heel lifting away from ground surface 20, such as while striding along the ground surface (as illustrated in FIG. 4).

As schematically illustrated in FIG. 1, sole assembly 100 may include a conformation bias element 150 configured to bias the sole assembly toward the raised conformation. More specifically, conformation bias element 150 may be configured to bias sole assembly 100 toward the raised conformation such that the sole assembly transitions from the raised conformation to the flattened conformation responsive to a compressive force being applied across a full length of the sole assembly (such as when the user steps upon the sole assembly) that is greater than a threshold transition force. As examples, the threshold transition force may be at least 20 Newtons (N), at least 30 N, at least 40 N, at least 50 N, at least 60 N, at least 70 N, at most 75 N, at most 65 N, at most 55 N, at most 45 N, at most 35 N, and/or at most 25 N.

Conformation bias element 150 may have any appropriate form and/or structure. For example, and as schematically illustrated in FIG. 1, conformation bias element 150 may include and/or be a spring insert 160 positioned within sole assembly 100, such as optionally between foot bed 120 and outsole 140. As additional examples, in an embodiment of sole assembly 100 that includes midsole layer 130, spring insert 160 may be positioned above the midsole layer and/or below the midsole layer.

When present, spring insert 160 is configured to resiliently flex as sole assembly 100 transitions between the raised conformation and the flattened conformation. Spring insert 160 may be more rigid than foot bed 120, midsole layer 130, and/or outsole 140. In such an embodiment, spring insert 160 also may be referred to as a shank. Additionally or alternatively, spring insert 160 may be configured to enhance a bending stiffness of sole assembly 100. As examples, spring insert 160 may be configured to provide sole assembly 100 with a lateral bending stiffness, a longitudinal bending stiffness, and/or a torsional bending stiffness that is greater than that of an otherwise identical sandal that lacks the spring insert. As examples, spring insert 160 may be formed of a material that has a flexural modulus, as measured via a flexural test such as ASTM D790, that is at least 1000 Megapascals (MPa), at least 2000 MPa, at least 3000 MPa, at least 4000 MPa, at least 5000 MPa, at most 5500 MPa, at most 4500 MPa, at most 3500 MPa, at most 2500 MPa, and/or at most 1500 MPa. Additionally or alternatively, foot bed 120, midsole layer 130, outsole 140, and/or conformation bias element 150 may be formed of a material that has such a flexural modulus.

In general, conformation bias element 150 and/or spring insert 160 may be configured to have a bending stiffness and/or a flexural modulus that is sufficiently large that the spring insert may overcome a stiffness and/or a rigidity of foot bed 120, midsole layer 130, and/or outsole 140 to bias sole assembly 100 toward the raised conformation. Additionally or alternatively, spring insert 160 may be configured to have a bending stiffness and/or a flexural modulus that is sufficiently small that sole assembly 100 is readily transitioned to the flattened conformation responsive to the user applying weight to sole assembly 100 and without causing fatigue in the user's foot when the user wears sandal 10.

Figure 6:
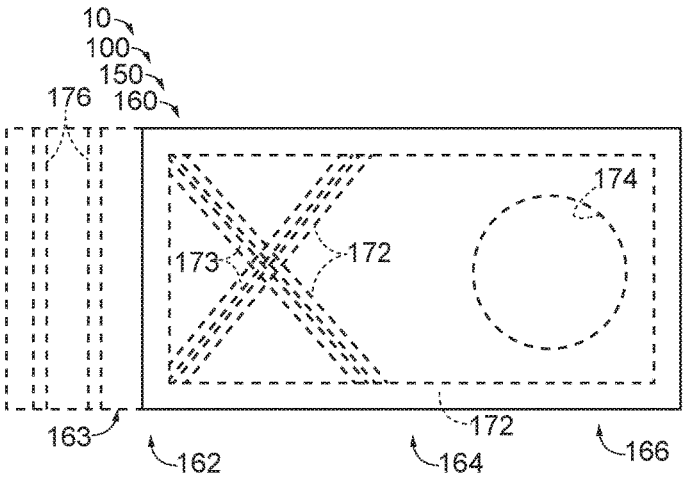
FIG. 6 is a schematic top plan view representing examples of spring inserts according to the present disclosure.
Figure 7:
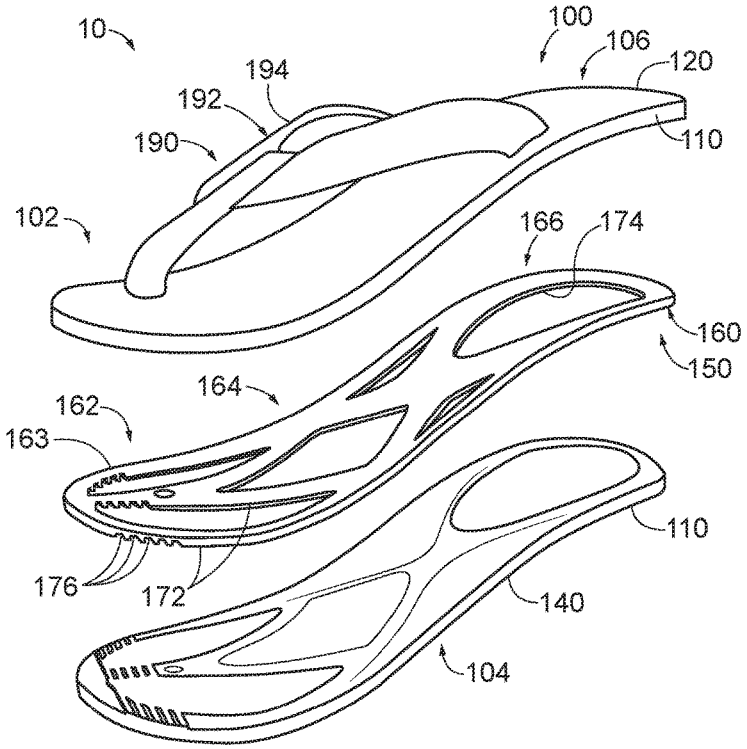
FIG. 7 is an exploded side perspective view representing an example of a sandal with a spring insert according to the present disclosure.
Figure 8:
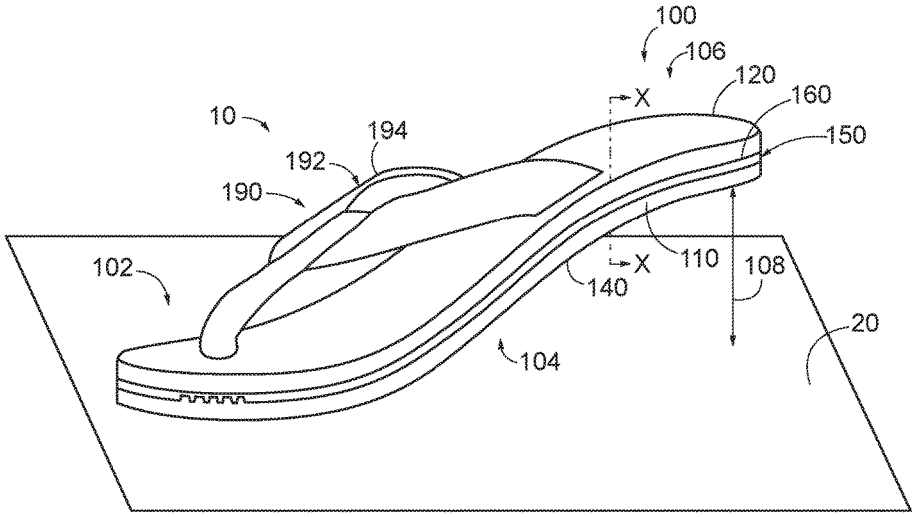
FIG. 8 is a side perspective view representing the sandal of FIG. 7 in an assembled configuration.
Figure 9:
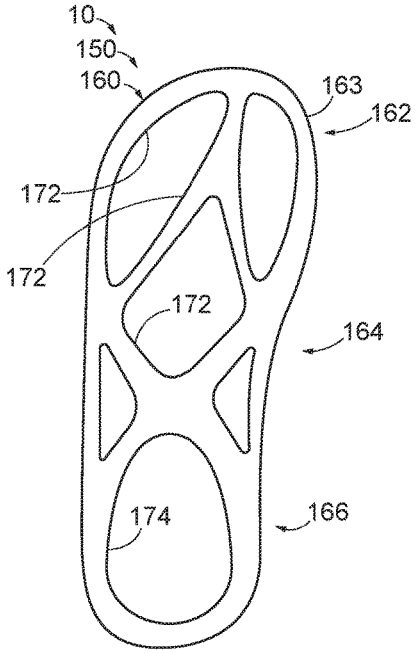
FIG. 9 is a top plan view representing the spring insert of the sandal of FIGS. 7-8.
Figure 10:
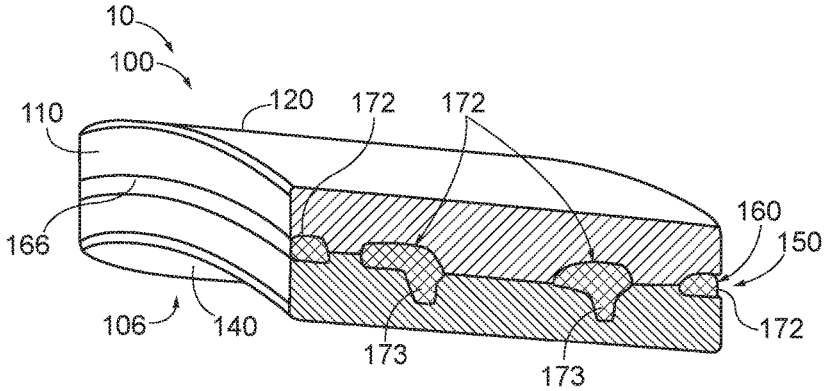
FIG. 10 is a cross-sectional front perspective view taken along the line X-X in FIG. 8.

FIG. 6 is a schematic illustration of examples of spring inserts 160 according to the present disclosure, while FIG. 7 is an exploded view of an example of a sandal 10 that includes spring insert 160, and FIG. 8 illustrates the sandal of FIG. 7 in an assembled state. FIG. 9 illustrates the spring insert 160 of the sandal 10 of FIGS. 7-8, and FIG. 10 is a cross-sectional view of the sandal of FIGS. 7-8 taken along the line X-X in FIG. 8. In an embodiment of sandal 10 that includes strap 192 and spring insert 160, such as the embodiment of FIGS. 7-8, the strap may extend through foot bed 120 such that the strap is coupled to the spring insert.

As schematically illustrated in FIG. 6, and as less schematically illustrated in FIG. 7, spring insert 160 may include and/or be characterized as having a spring insert forefoot region 162, a spring insert midfoot region 164, and/or a spring insert heel region 166. As illustrated in FIG. 7, spring insert forefoot region 162 may be positioned within and/or correspond to forefoot region 102 of sole assembly 100, spring insert midfoot region 164 may be positioned within and/or correspond to midfoot region 104 of the sole assembly, and/or spring insert heel region 166 may be positioned within and/or correspond to heel region 106 of the sole assembly. In some examples, and as schematically illustrated in dashed lines in FIG. 6, spring insert forefoot region 162 includes a spring insert toe region 163 that is positioned under the wearer's toes when the wearer wears sandal 10.

Spring insert 160 may be configured to exhibit localized and/or zonal functionality. For example, at least one of spring insert forefoot region 162, spring insert midfoot region 164, and spring insert heel region 166 may have a bending stiffness that is less than at least one other of the spring insert forefoot region, the spring insert midfoot region, and the spring insert heel region. As a more specific example, spring insert toe region 163 may have a bending stiffness that is less than that of a remainder of spring insert forefoot region 162, of spring insert midfoot region 164, and/or of spring insert heel region 166. As a still more specific example, and as schematically illustrated in FIG. 6 and as less schematically illustrated in FIG. 7, spring insert toe region 163 may define at least one spring insert groove 176 configured to reduce a bending stiffness of the spring insert toe region relative to an otherwise identical spring insert toe region that lacks the spring insert groove. Stated differently, each spring insert groove 176 may be configured to provide spring insert toe region 163 with a smaller bending stiffness relative to an otherwise identical spring insert toe region that lacks the spring insert groove. Such a configuration may facilitate flexure of forefoot region 102 of sole assembly 100 while the wearer walks along ground surface 20, while providing an increased torsional stiffness in the forefoot region relative to an otherwise identical sandal 10 in which spring insert 160 does not include spring insert toe region 163. For example, and as illustrated in FIG. 4, forefoot region 102 and/or the wearer's toes may flex and/or bend when the forefoot region remains in contact with ground surface 20 immediately prior to fully lifting sole assembly 100 off of the ground surface, and spring insert groove(s) 176 may facilitate such flexure and/or bending.

Spring insert 160 may have any appropriate shape and/or construction. As examples, spring insert 160 may be formed of a plastic, a polymer, polystyrene (PS), a nylon, a fiber-filled nylon, and/or a metal. Additionally or alternatively, and as schematically illustrated in FIG. 6 and as less schematically illustrated in FIGS. 7 and 9-10, spring insert 160 may include and/or be defined by at least one spring insert frame element 172. Stated differently, spring insert 160 may be at least partially defined by at least one spring insert frame element that defines and/or extends from a perimeter of the spring insert. Such a configuration may reduce a material cost and/or overall stiffness of spring insert 160 relative to a configuration in which the spring insert at least substantially fills the area defined by the outer perimeter thereof.

As schematically illustrated in FIG. 6, and as less schematically illustrated in FIG. 10, one or more spring insert frame elements 172 may include and/or define a spring insert frame rib 173 extending along a length thereof. Spring insert frame rib 173, when present, is configured to increase a bending stiffness of spring insert frame element 172. Stated differently, spring insert frame rib 173 may be configured to provide spring insert frame element 172 with a greater bending stiffness relative to an otherwise identical spring insert frame element that lacks the spring insert frame rib. As shown in FIG. 10, spring insert frame rib 173 may extend along an underside of spring insert frame element 172. However, this is not required to all spring inserts 160 according to the present disclosure, and it is within the scope of the present disclosure that spring insert frame rib 173 additionally or alternatively may extend along an upper side of spring insert frame element 172.

As further schematically illustrated in FIG. 6, and as less schematically illustrated in FIGS. 7 and 9, spring insert 160 may include and/or define at least one heel aperture 174 positioned in spring insert heel region 166. In such an embodiment, and as illustrated in FIGS. 7 and 9, heel aperture 174 at least partially may be defined by at least one spring insert frame element 172. Heel aperture 174 may enhance a cushioning property of heel region 106 of sole assembly 100. For example, foot bed 120, midsole layer 130, and/or outsole 140 may extend at least partially through heel aperture 174, such as to contact at least one other of the foot bed, the midsole layer, and the outsole via the heel aperture. Stated differently, heel aperture 174 may permit transmission of a localized compression force through the heel aperture, such as when the wearer applies weight to heel region 106.

With continued reference to FIGS. 7-8 and 10, spring insert 160 may be positioned in sole assembly 100 in any appropriate manner. For example, and as illustrated in FIGS. 8 and 10, spring insert 160 may be exposed and/or visible from exterior sole assembly 100. As a more specific example, sole assembly 100 may be described as including and/or defining a peripheral sidewall 110 extending around a circumference of the sole assembly, and spring insert 160 may be exposed along and/or visible along the peripheral sidewall. As still more specific examples, spring insert 160 may be exposed along and/or visible along at least 50%, at least 75%, at least 90%, and/or at most 100% of a perimeter of peripheral sidewall 110. As additionally illustrated in FIGS. 7 and 10, foot bed 120, midsole layer 130, and/or outsole 140 may be molded to conform to spring insert 160. For example, foot bed 120, midsole layer 130, and/or outsole 140 may include projections and/or recesses that correspond to and/or conform to a shape of spring insert 160, such as to a shape of spring insert frame element(s) 172, spring insert frame rib(s) 173, and/or spring insert groove(s) 176.

Figure 11:
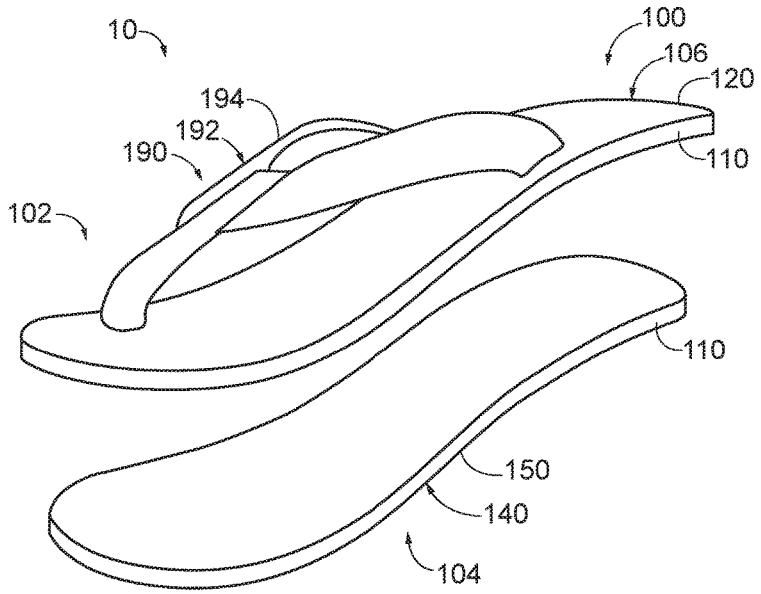
FIG. 11 is an exploded side perspective view representing an example of a sandal with an outsole that includes a conformation bias element according to the present disclosure.
Figure 12:
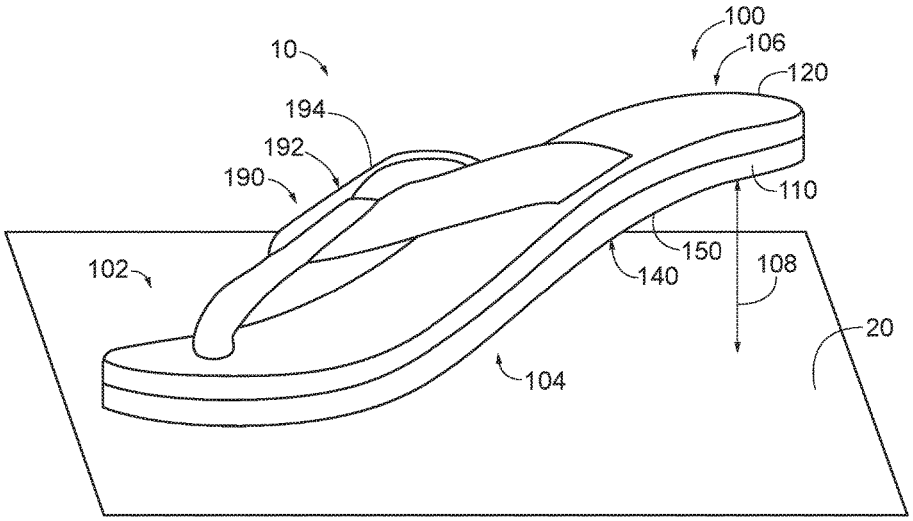
FIG. 12 is a side perspective view representing the sandal of FIG. 11 in an assembled configuration.

As another example of conformation bias element 150, and as schematically illustrated in FIG. 1, foot bed 120, midsole layer 130, and/or outsole 140 may include, at least partially define, and/or be the conformation bias element. For example, foot bed 120, midsole layer 130, and/or outsole 140 may be more rigid than at least one other of the foot bed, the midsole layer, and the outsole. Additionally or alternatively, foot bed 120, midsole layer 130, and/or outsole 140 may be configured to resiliently flex to transition sole assembly 100 between the raised conformation and the flattened conformation. As an example, outsole 140 may be molded in the raised conformation and may be more rigid than a remainder of sole assembly 100. In such an embodiment, the outsole may bias the sole assembly toward the raised conformation and may resiliently flex to transition the sole assembly between the raised conformation and the flattened conformation. Such an embodiment is illustrated in FIGS. 11-12. Specifically, in the embodiment of FIGS. 11-12, outsole 140 defines conformation bias element 150 and is configured to resiliently flex to transition sole assembly 100 between the raised conformation and the flattened conformation.

Figure 13:
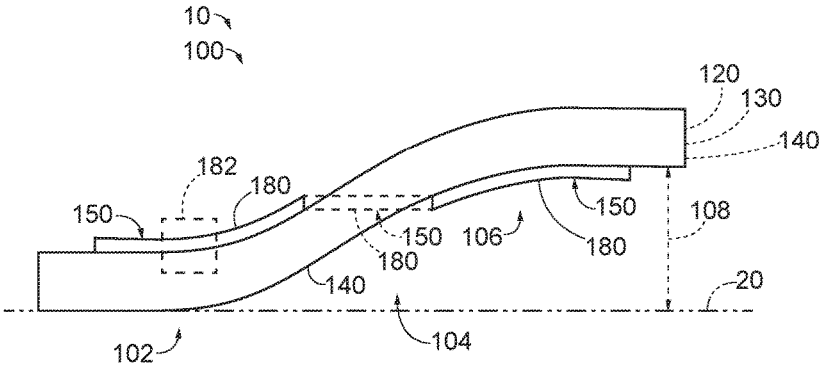
FIG. 13 is a schematic side elevation view representing examples of sandals with tension elements according to the present disclosure.

As still another example of conformation bias element 150, and as schematically illustrated in FIGS. 1 and 13, the conformation bias element may include and/or be a tension element 180 configured to bias sole assembly 100 toward the raised conformation. Specifically, FIG. 13 illustrates a portion of sole assembly 100 in the raised conformation. More specifically, tension element 180 may be configured to apply a tension force to sole assembly 100 to bias the sole assembly toward the raised conformation, as schematically illustrated in FIG. 13. As examples, tension element 180 may include and/or be a strap, a band, a webbing, a cord, and/or a wire, and/or may be integrated into, bonded to, affixed to, and/or otherwise coupled to sole assembly 100.

As schematically illustrated in FIG. 13, tension element 180 may be coupled to foot bed 120, midsole layer 130, and/or outsole 140, such as along a length and/or around a perimeter thereof. Tension element 180 may apply the tension force to sole assembly 100 in any appropriate manner to bias the sole assembly toward the raised conformation. For example, tension element 180 may apply the tension force to forefoot region 102 and/or midfoot region 104 of sole assembly 100 such that the top surface of foot bed 120 is concave in the forefoot region and/or the midfoot region 104 and/or such that the bottom surface of outsole 140 is convex in the forefoot region and/or the midfoot region. As a more specific example, tension element 180 may apply the tension force across forefoot region 102 and midfoot region 104. Additionally or alternatively, tension element 180 may apply the tension force to midfoot region 104 and/or heel region 106 of sole assembly 100 such that the top surface of foot bed 120 is convex in the forefoot region and/or the midfoot region and/or such that the bottom surface of outsole 140 is concave in the forefoot region and/or the midfoot region. As a more specific example, tension element 180 may apply the tension force across midfoot region 104 and heel region 106.

As additionally schematically illustrated in dashed lines in FIG. 13, tension element 180 may extend at least partially through foot bed 120, midsole layer 130, and/or outsole 140. As a more specific example, tension element 180 may extend through sole assembly 100 such that the tension element applies the tension force between the top surface of foot bed 120 in forefoot region 102 and the bottom surface of outsole 140 in heel region 106.

As further schematically illustrated in FIG. 13, conformation bias element 150 may include a tension adjuster 182 configured to permit the wearer to selectively adjust the tension force of tension element 180. For example, the wearer may selectively adjust the tension force to selectively vary heel offset 108 and/or a stiffness of conformation bias element 150. As more specific examples, tension adjuster 182 may include and/or be a slide, a dial, a clasp, and/or a ratchet.

Examples of sandals according to the present disclosure are presented in the following enumerated paragraphs.

A1. A sandal, comprising:

a sole assembly configured to transition between a flattened conformation and a raised conformation; and a retention structure configured to least partially retain the sole assembly against a wearer's foot;

wherein the sole assembly has:

a forefoot region configured to be positioned under the wearer's forefoot when the wearer wears the sandal;

a heel region configured to be positioned under the wearer's heel when the wearer wears the sandal; and a midfoot region extending between the forefoot region and the heel region;

wherein the sole assembly includes:

a foot bed configured to face the wearer's foot when the wearer wears the sandal; and an outsole extending underneath the foot bed and configured to contact a ground surface when the wearer wears the sandal and walks upon the ground surface;

wherein in the flattened conformation, the sole assembly is at least substantially flat;

wherein in the raised conformation, the sole assembly is contoured to raise the heel region relative to the forefoot region; and wherein the sole assembly is biased toward the raised conformation.

A2. The sandal of paragraph A1, wherein at least one of the forefoot region, the midfoot region, and/or the heel region individually occupies at least one of at least 5% of a longitudinal extent of the sole assembly as measured in an anterior-posterior direction, at least 10% of the longitudinal extent of the sole assembly, at least 15% of the longitudinal extent of the sole assembly, at least 20% of the longitudinal extent of the sole assembly, at least 25% of the longitudinal extent of the sole assembly, at least 30% of the longitudinal extent of the sole assembly, at least 35% of the longitudinal extent of the sole assembly, at least 40% of the longitudinal extent of the sole assembly, at least 45% of the longitudinal extent of the sole assembly, at least 50% of the longitudinal extent of the sole assembly, at least 55% of the longitudinal extent of the sole assembly, less than 100% of the longitudinal extent of the sole assembly, less than 90% of the longitudinal extent of the sole assembly, less than 70% of the longitudinal extent of the sole assembly, less than 60% of the longitudinal extent of the sole assembly, less than 57% of the longitudinal extent of the sole assembly, less than 53% of the longitudinal extent of the sole assembly, less than 47% of the longitudinal extent of the sole assembly, less than 43% of the longitudinal extent of the sole assembly, less than 37% of the longitudinal extent of the sole assembly, less than 33% of the longitudinal extent of the sole assembly, less than 27% of the longitudinal extent of the sole assembly, less than 23% of the longitudinal extent of the sole assembly, less than 17% of the longitudinal extent of the sole assembly, less than 13% of the longitudinal extent of the sole assembly, less than 7% of the longitudinal extent of the sole assembly, and less than 3% of the longitudinal extent of the sole assembly.

A3. The sandal of any of paragraphs A1-A2, wherein the sandal is configured to maintain the heel region of the sole assembly at least substantially in contact with the wearer's heel as the wearer walks upon the ground surface while wearing the sandal.

A4. The sandal of any of paragraphs A1-A3, wherein a top surface of the foot bed is concave in at least one of the forefoot region of the sole assembly and the midfoot region of the sole assembly when the sole assembly is in the raised conformation.

A5. The sandal of any of paragraphs A1-A4, wherein a bottom surface of the outsole is convex in at least one of the forefoot region of the sole assembly and the midfoot region of the sole assembly when the sole assembly is in the raised conformation.

A6. The sandal of any of paragraphs A1-A5, wherein a/the top surface of the foot bed is convex in at least one of the midfoot region of the sole assembly and the heel region of the sole assembly when the sole assembly is in the raised conformation.

A7. The sandal of any of paragraphs A1-A6, wherein a/the bottom surface of the outsole is concave in at least one of the midfoot region of the sole assembly and the heel region of the sole assembly when the sole assembly is in the raised conformation.

A8. The sandal of any of paragraphs A1-A7, wherein, when the sole assembly is in the raised conformation, the forefoot region of the sole assembly extends at least substantially in a forefoot plane and the heel region of the sole assembly is offset from the forefoot plane by a heel offset, as measured between the forefoot plane and a portion of the outsole in the heel region of the sole assembly that is maximally distal the forefoot plane, in a direction perpendicular to the forefoot plane.

A9. The sandal of paragraph A8, wherein the heel offset is at least one of at least 40 millimeters (mm), at least 60 mm, at least 80 mm, at least 100 mm, at most 110 mm, at most 90 mm, at most 70 mm, and at most 50 mm.

A10. The sandal of any of paragraphs A1-A9, wherein the sole assembly is configured to transition from the raised conformation to the flattened conformation responsive to the wearer stepping on the ground surface while the wearer wears the sandal.

A11. The sandal of paragraph A10, wherein the sole assembly is configured to transition from the raised conformation to the flattened conformation responsive to the wearer compressing each of the forefoot region and the heel region of the sole assembly against the ground surface while the wearer wears the sandal.

A12. The sandal of any of paragraphs A1-A11, wherein the sole assembly is configured to transition from the flattened conformation to the raised conformation responsive to the wearer's heel lifting away from the ground surface.

A13. The sandal of any of paragraphs A1-A12, wherein the sole assembly is configured to assume the raised conformation when the heel region of the sole assembly is lifted away from the ground surface and the forefoot region of the sole assembly contacts the ground surface.

A14. The sandal of any of paragraphs A1-A13, wherein the foot bed is coupled to the outsole.

A15. The sandal of any of paragraphs A1-A13, wherein the foot bed and the outsole are integrally formed.

A16. The sandal of any of paragraphs A1-A15, wherein the sole assembly further includes a midsole layer positioned between the foot bed and the outsole.

A17. The sandal of any of paragraphs A1-A16, wherein at least one of the foot bed, the outsole, and a/the midsole layer is configured to provide arch support to an arch region of the wearer's foot when the wearer wears the sandal.

A18. The sandal of any of paragraphs A1-A17, wherein the sandal further includes a conformation bias element configured to bias the sole assembly toward the raised conformation.

A19. The sandal of paragraph A18, wherein the conformation bias element is configured such that the sole assembly transitions from the raised conformation to the flattened conformation responsive to a compressive force being applied to a full length of the sole assembly that is greater than a threshold transition force, and wherein the threshold transition force is at least one of at least 20 Newtons (N), at least 30 N, at least 40 N, at least 50 N, at least 60 N, at least 70 N, at most 75 N, at most 65 N, at most 55 N, at most 45 N, at most 35 N, and at most 25 N.

A20. The sandal of any of paragraphs A18-A19, wherein the conformation bias element includes a spring insert positioned within the sole assembly, optionally between the foot bed and the outsole.

A21. The sandal of paragraph A20, wherein the spring insert is positioned above a/the midsole layer of the sole assembly.

A22. The sandal of any of paragraphs A20-A21, wherein the spring insert is positioned below a/the midsole layer of the sole assembly.

A23. The sandal of any of paragraphs A20-A22, wherein the spring insert is more rigid than at least one of the foot bed, the outsole, and a/the midsole layer.

A24. The sandal of any of paragraphs A20-A23, wherein the spring insert is configured to provide the sole assembly with at least one of a greater lateral bending stiffness, a greater longitudinal bending stiffness, and a greater torsional bending stiffness of the sole assembly, relative to an otherwise identical sandal that lacks the spring insert.

A25. The sandal of any of paragraphs A20-A24, wherein at least one of the foot bed, a/the midsole layer, the spring insert, and the outsole is formed of a material that has a flexural modulus, as measured via flexural test ASTM D790, that is at least one of at least 1000 Megapascals (MPa), at least 2000 MPa, at least 3000 MPa, at least 4000 MPa, at least 5000 MPa, at most 5500 MPa, at most 4500 MPa, at most 3500 MPa, at most 2500 MPa, and at most 1500 MPa.

A26. The sandal of any of paragraphs A20-A25, wherein the spring insert has:

- a spring insert forefoot region positioned within the forefoot region of the sole assembly;
- a spring insert midfoot region positioned within the midfoot region of the sole assembly; and
- a spring insert heel region positioned within the heel region of the sole assembly.

A27. The sandal of paragraph A26, wherein the spring insert forefoot region includes a spring insert toe region that is positioned under the wearer's toes when the wearer wears the sandal.

A28. The sandal of any of paragraphs A26-A27, wherein at least one of the spring insert forefoot region, the spring insert midfoot region, and the spring insert heel region has a bending stiffness that is less than at least one other of the spring insert forefoot region, the spring insert midfoot region, and the spring insert heel region.

A29. The sandal of any of paragraphs A26-A28, wherein a/the spring insert toe region has a bending stiffness that is less than a bending stiffness of at least one of a remainder of the spring insert forefoot region, the spring insert midfoot region, and the spring insert heel region.

A30. The sandal of any of paragraphs A27-A29, wherein the spring insert toe region defines at least one spring insert groove configured to provide the spring insert toe region with a smaller bending stiffness relative to an otherwise identical spring insert toe region that lacks the spring insert groove.

A31. The sandal of any of paragraphs A20-A30, wherein the spring insert is configured to resiliently flex to transition the sole assembly between the raised conformation and the flattened conformation.

A32. The sandal of any of paragraphs A20-A31, wherein the spring insert includes at least one spring insert frame element.

A33. The sandal of paragraph A32, wherein at least one spring insert frame element includes a spring insert frame rib extending along a length of the spring insert frame element.

A34. The sandal of paragraph A33, wherein the spring insert frame rib is configured to provide the spring insert frame element with a greater bending stiffness relative to an otherwise identical spring insert frame element that lacks the spring insert frame rib.

A35. The sandal of any of paragraphs A33-A34, wherein the spring insert frame rib extends along an underside of the spring insert frame element.

A36. The sandal of any of paragraphs A33-A35, wherein the spring insert frame rib extends along an upper side of the spring insert frame element.

A37. The sandal of any of paragraphs A20-A36, wherein the spring insert is formed of at least one of a plastic, a polymer, polystyrene (PS), a nylon, a fiber-filled nylon, and a metal.

A38. The sandal of any of paragraphs A20-A37, wherein the spring insert is at least one of exposed and visible from exterior the sole assembly.

A39. The sandal of any of paragraphs A20-A38, wherein the sole assembly includes a peripheral sidewall, and wherein the spring insert is at least one of exposed along the peripheral sidewall and visible along the peripheral sidewall.

A40. The sandal of paragraph A39, wherein the spring insert is at least one of exposed and visible along at least one of at least 50%, at least 75%, at least 90%, and at most 100% of a perimeter of the peripheral sidewall.

A41. The sandal of any of paragraphs A20-A40, wherein the spring insert defines at least one heel aperture positioned within a/the spring insert heel region.

A42. The sandal of paragraph A41, wherein the heel aperture is at least partially defined by a/the at least one spring insert frame element.

A43. The sandal of any of paragraphs A41-A42, wherein at least one of the foot bed, the outsole, and a/the midsole layer extends at least partially through the heel aperture.

A44. The sandal of paragraph A43, wherein at least one of the foot bed, the outsole, and the midsole layer is configured to contact at least one other of the foot bed, the outsole, and the midsole layer via the heel aperture.

A45. The sandal of any of paragraphs A20-A44, wherein at least one of the foot bed, the outsole, and a/the midsole layer is molded to conform to the spring insert.

A46. The sandal of any of paragraphs A18-A45, wherein at least one of the foot bed, the outsole, and a/the midsole layer includes the conformation bias element.

A47. The sandal of paragraph A46, wherein the conformation bias element is at least partially defined by at least one of the foot bed, the outsole, and a/the midsole layer.

A48. The sandal of any of paragraphs A46-A47, wherein at least one of the foot bed, the outsole, and the midsole layer is more rigid than at least one other of the foot bed, the outsole, and the midsole layer.

A49. The sandal of any of paragraphs A46-A48, wherein at least one of the foot bed, the outsole, and the midsole layer is configured to resiliently flex to transition the sole assembly between the raised conformation and the flattened conformation.

A50. The sandal of any of paragraphs A18-A49, wherein the conformation bias element includes a tension element that applies a tension force to the sole assembly to bias the sole assembly toward the raised conformation.

A51. The sandal of paragraph A50, wherein the tension element is coupled to at least one of the foot bed, the outsole, and a/the midsole layer.

A52. The sandal of any of paragraphs A50-A51, wherein the tension element includes at least one of a strap, a band, a webbing, a cord, and a wire.

A53. The sandal of any of paragraphs A50-A52, wherein the tension element applies the tension force to at least one of the forefoot region of the sole assembly and the midfoot region of the sole assembly such that a/the top surface of the foot bed is concave in at least one of the forefoot region of the sole assembly and the midfoot region of the sole assembly when the sole assembly is in the raised conformation.

A54. The sandal of any of paragraphs A50-A53, wherein the tension element applies the tension force to at least one of the forefoot region of the sole assembly and the midfoot region of the sole assembly such that a/the bottom surface of the outsole is convex in at least one of the forefoot region of the sole assembly and the midfoot region of the sole assembly when the sole assembly is in the raised conformation.

A55. The sandal of any of paragraphs A50-A54, wherein the tension element applies the tension force to at least one of the midfoot region of the sole assembly and the heel region of the sole assembly such that a/the top surface of the foot bed is convex in at least one of the forefoot region of the sole assembly and the midfoot region of the sole assembly when the sole assembly is in the raised conformation.

A56. The sandal of any of paragraphs A50-A55, wherein the tension element applies the tension force to at least one of the midfoot region of the sole assembly and the heel region of the sole assembly such that a/the bottom surface of the outsole is concave in at least one of the forefoot region of the sole assembly and the midfoot region of the sole assembly when the sole assembly is in the raised conformation.

A57. The sandal of any of paragraphs A50-A56, wherein the tension element extends at least partially through at least one of the foot bed, the outsole, and a/the midsole layer.

A58. The sandal of any of paragraphs A50-A57, wherein the conformation bias element includes a tension adjuster configured to permit the wearer to selectively adjust the tension force.

A59. The sandal of paragraph A58, wherein the tension adjuster includes at least one of a slide, a dial, a clasp, and a ratchet.

A60. The sandal of any of paragraphs A1-A59, wherein the retention structure includes at least one strap that is operatively coupled to the sole assembly.

A61. The sandal of paragraph A60, wherein at least one strap extends at least partially through the foot bed.

A62. The sandal of paragraph A61, wherein at least one strap is coupled to a/the spring insert.

A63. The sandal of any of paragraphs A60-A62, wherein the at least one strap includes at least one forefoot strap configured to overlie at least a portion of the wearer's forefoot when the wearer wears the sandal.

A64. The sandal of any of paragraphs A60-A63, wherein the at least one strap includes at least one heel strap configured to at least partially wrap around the wearer's heel when the wearer wears the sandal.

A65. The sandal of any of paragraphs A1-A64, wherein the retention structure includes a heel cup configured to cradle at least a portion of the wearer's heel when the wearer wears the sandal.

A66. The sandal of any of paragraphs A1-A65, wherein the sandal is at least one of a thong sandal and a flip-flop sandal.

A67. The sandal of any of paragraphs A1-A66, wherein the sandal is free of a heel strap configured to at least partially wrap around the wearer's heel when the wearer wears the sandal.

A68. The sandal of any of paragraphs A1-A67, wherein the sandal is free of an upper configured to at least substantially surround the wearer's foot when the wearer wears the sandal.

A69. The sandal of any of paragraphs A1-A68, wherein the sandal is free of a mechanical fastener for selectively adjusting the size of the retention structure.

A70. The sandal of any of paragraphs A1-A69, wherein the foot bed is formed of at least one of a plastic, a rubber, a leather, a natural fiber, a polymer, a foam, ethylene vinyl acetate (EVA), and polyurethane (PU).

A71. The sandal of any of paragraphs A1-A70, when dependent from paragraph A16, wherein the midsole layer is formed of at least one of a plastic, a rubber, a leather, a natural fiber, a polymer, a foam, EVA, and PU.

A72. The sandal of any of paragraphs A1-71, wherein the outsole is formed of at least one of a plastic, a rubber, a leather, a natural fiber, a polymer, a foam, EVA, and PU.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A sandal, comprising:

a sole assembly configured to transition between a flattened conformation and a raised conformation; and a retention structure configured to at least partially retain the sole assembly against a wearer's foot;

wherein the sole assembly has:

a forefoot region configured to be positioned under the wearer's forefoot when the wearer wears the sandal;

a heel region configured to be positioned under the wearer's heel when the wearer wears the sandal; and a midfoot region extending between the forefoot region and the heel region;

wherein the sole assembly includes:

a foot bed configured to face the wearer's foot when the wearer wears the sandal; and an outsole extending underneath the foot bed and configured to contact a ground surface when the wearer wears the sandal and walks upon the ground surface;

wherein in the flattened conformation, the sole assembly is at least substantially flat; wherein in the raised conformation, the sole assembly is contoured to raise the heel region relative to the forefoot region; wherein the sole assembly is biased toward the raised conformation when the sole assembly is unloaded; wherein the sole assembly further includes a conformation bias element configured to bias the sole assembly toward the raised conformation when the sole assembly is unloaded and configured to resiliently flex to transition the sole assembly between the raised conformation and the flattened conformation; and wherein at least a portion of the conformation bias element is positioned in the forefoot region of the sole assembly away from a perimeter of the forefoot region of the sole assembly.

2. The sandal of claim 1, wherein a bottom surface of the outsole is concave in at least one of the midfoot region of the sole assembly and the heel region of the sole assembly when the sole assembly is in the raised conformation.

3. The sandal of claim 1, wherein the conformation bias element includes a spring insert positioned between the foot bed and the outsole, wherein the spring insert is configured to resiliently flex to transition the sole assembly between the raised conformation and the flattened conformation.

4. The sandal of claim 3, wherein the spring insert is more rigid than each of the foot bed and the outsole.

5. The sandal of claim 3, wherein the spring insert has:

a spring insert forefoot region positioned within the forefoot region of the sole assembly;

a spring insert midfoot region positioned within the midfoot region of the sole assembly; and a spring insert heel region positioned within the heel region of the sole assembly; and wherein at least one of the spring insert forefoot region, the spring insert mid foot region, and the spring insert heel region has a bending stiffness that is less than a bending stiffness of at least one other of the spring insert forefoot region, the spring insert midfoot region, and the spring insert heel region.

6. The sandal of claim 5, wherein the spring insert forefoot region includes a spring insert toe region that is positioned under the wearer's toes when the wearer wears the sandal, and wherein the spring insert toe region defines at least one spring insert groove.

7. The sandal of claim 3, wherein the spring insert includes at least one spring insert frame element, and wherein at least one spring insert frame element includes a spring insert frame rib extending along a length of the spring insert frame element.

8. The sandal of claim 3, wherein the sole assembly includes a peripheral sidewall, and wherein the spring insert is exposed along at least 75% of a perimeter of the peripheral sidewall.

9. The sandal of claim 3, wherein the spring insert defines at least one heel aperture positioned within a spring insert heel region, and wherein at least one of the foot bed and the outsole extends at least partially through the heel aperture.

10. The sandal of claim 1, wherein at least one of:

(i) the foot bed at least partially incorporates the conformation bias element; and (ii) the outsole at least partially incorporates the conformation bias element.

11. The sandal of claim 10, wherein one of:

(i) the foot bed defines the conformation bias element and is more rigid than the outsole; and (ii) the outsole defines the conformation bias element and is more rigid than the foot bed.

12. The sandal of claim 1, wherein the conformation bias element includes a tension element that applies a tension force to the sole assembly to bias the sole assembly toward the raised conformation.

13. The sandal of claim 12, wherein the tension element includes at least one of a strap, a band, a webbing, a cord, and a wire.

14. The sandal of claim 13, wherein the tension element extends through at least one of the foot bed and the outsole.

15. The sandal of claim 1, wherein the sandal is free of a heel strap configured to at least partially wrap around the wearer's heel when the wearer wears the sandal.

16. The sandal of claim 7, wherein the conformation bias element includes at least one forefoot frame element that extends away from the perimeter of the forefoot region of the sole assembly.

17. The sandal of claim 7, wherein at least one spring insert frame element extends away from the perimeter of the forefoot region of the sole assembly.

18. A sandal, comprising:

a sole assembly configured to transition between a flattened conformation and a raised conformation; and a retention structure configured to at least partially retain the sole assembly against a wearer's foot;

wherein the sole assembly has:

a forefoot region configured to be positioned under the wearer's forefoot when the wearer wears the sandal;

a heel region configured to be positioned under the wearer's heel when the wearer wears the sandal; and a midfoot region extending between the forefoot region and the heel region;

wherein the sole assembly includes:

a foot bed configured to face the wearer's foot when the wearer wears the sandal; and an outsole extending underneath the foot bed and configured to contact a ground surface when the wearer wears the sandal and walks upon the ground surface;

wherein in the flattened conformation, the sole assembly is at least substantially flat; wherein in the raised conformation, the sole assembly is contoured to raise the heel region relative to the forefoot region; wherein the sole assembly is biased toward the raised conformation when the sole assembly is unloaded; wherein the sole assembly further includes a spring insert configured to bias the sole assembly toward the raised conformation when the sole assembly is unloaded and configured to resiliently flex to transition the sole assembly between the raised conformation and the flattened conformation; wherein the spring insert is more rigid than each of the foot bed and the outsole; wherein the spring insert defines at least one heel aperture positioned within a spring insert heel region; wherein at least one of the foot bed and the outsole extends at least partially through the heel aperture; and wherein at least a portion of the spring insert is positioned in the forefoot region of the sole assembly away from a perimeter of the forefoot region of the sole assembly.

19. The sandal of claim 18, wherein the spring insert includes at least one spring insert frame element that extends away from a perimeter of the spring insert in the forefoot region of the sole assembly.

20. A sandal, comprising:

a sole assembly configured to transition between a flattened conformation and a raised conformation; and a retention structure configured to at least partially retain the sole assembly against a wearer's foot;

wherein the sole assembly has:

a forefoot region configured to be positioned under the wearer's forefoot when the wearer wears the sandal;

a heel region configured to be positioned under the wearer's heel when the wearer wears the sandal; and a midfoot region extending between the forefoot region and the heel region;

wherein the solo assembly includes:

a foot bed configured to face the wearer's foot when the wearer wears the sandal; and an outsole extending underneath the foot bed and configured to contact a ground surface when the wearer wears the sandal and walks upon the ground surface;

wherein in the flattened conformation, the sole assembly is at least substantially flat; wherein in the raised conformation, the sole assembly is contoured to raise the heel region relative to the forefoot region; wherein the sole assembly is biased toward the raised conformation; wherein the sole assembly further includes a conformation bias element configured to bias the sole assembly toward the raised conformation; wherein the conformation bias element includes a spring insert positioned between the foot bed and the outsole; wherein the spring insert is configured to resiliently flex to transition the sole assembly between the raised conformation and the flattened conformation; wherein the spring insert has:

a spring insert forefoot region positioned within the forefoot region of the sole assembly;

a spring insert midfoot region positioned within the midfoot region of the sole assembly; and a spring insert heel region positioned within the heel region of the sole assembly;

wherein at least one of the spring insert forefoot region, the spring insert midfoot region, and the spring insert heel region has a bending stiffness that is less than a bending stiffness of at least one other of the spring insert forefoot region, the spring insert midfoot region, and the spring insert heel region; wherein the spring insert forefoot region includes a spring insert toe region that is positioned under the wearer's toes when the wearer wears the sandal; and wherein the spring insert toe region defines at least one spring insert groove.

21. A sandal, comprising:

a sole assembly configured to transition between a flattened conformation and a raised conformation; and a retention structure configured to at least partially retain the sole assembly against a wearer's foot;

wherein the sole assembly has:

a forefoot region configured to be positioned under the wearer's forefoot when the wearer wears the sandal;

a heel region configured to be positioned under the wearer's heel when the wearer wears the sandal; and a midfoot region extending between the forefoot region and the heel region;

wherein the sole assembly includes:

a foot bed configured to face the wearer's foot when the wearer wears the sandal; and an outsole extending underneath the foot bed and configured to contact a ground surface when the wearer wears the sandal and walks upon the ground surface;

wherein in the flattened conformation; the sole assembly is at least substantially flat; wherein in the raised conformation, the sole assembly is contoured to raise the heel region relative to the forefoot region; wherein the sole assembly is biased toward the raised conformation; wherein the sole assembly further includes a conformation bias element configured to bias the sole assembly toward the raised conformation; wherein the conformation bias element includes a spring insert positioned between the foot bed and the outsole; wherein the spring insert is configured to resiliently flex to transition the sole assembly between the raised conformation and the flattened conformation; wherein the spring insert includes at least one spring insert frame element; and wherein at least one spring insert frame element includes a spring insert frame rib extending along a length of the spring insert frame element.

* * * * *